US008376087B2

(12) United States Patent
Moss et al.

(10) Patent No.: US 8,376,087 B2
(45) Date of Patent: Feb. 19, 2013

(54) COMBINATION LADDER, LADDER COMPONENTS AND METHODS OF MANUFACTURING SAME

(75) Inventors: Newell Ryan Moss, Mapleton, UT (US); Jack W. Bowers, Springville, UT (US); David Francis, Orem, UT (US)

(73) Assignee: Wing Enterprises, Inc., Springville, UT (US)

( * ) Notice: Subject to any disclaimer, the term of this patent is extended or adjusted under 35 U.S.C. 154(b) by 0 days.

(21) Appl. No.: 13/311,321

(22) Filed: Dec. 5, 2011

(65) Prior Publication Data

US 2012/0160609 A1 Jun. 28, 2012

Related U.S. Application Data

(60) Continuation of application No. 12/111,891, filed on Apr. 29, 2008, now Pat. No. 8,069,948, which is a division of application No. 10/706,308, filed on Nov. 11, 2003, now Pat. No. 7,364,017.

(60) Provisional application No. 60/425,449, filed on Nov. 11, 2002.

(51) Int. Cl.
*E06C 1/00* (2006.01)

(52) U.S. Cl. ..... 182/163; 182/23

(58) Field of Classification Search ..... 182/163, 182/23

See application file for complete search history.

(56) References Cited

U.S. PATENT DOCUMENTS

| | | | | |
|---|---|---|---|---|
| 305,347 | A | 9/1884 | Smith | |
| 437,936 | A * | 10/1890 | O'Brien | 182/104 |
| 453,193 | A | 6/1891 | Kinser | |
| 674,950 | A | 5/1901 | Williamson | |
| 1,013,515 | A | 1/1912 | Reed | |
| 1,116,073 | A | 11/1914 | Johnson et al. | |
| 1,973,774 | A | 9/1934 | Pflugradt | |
| 2,144,440 | A | 1/1939 | Gaffers | |
| 2,186,119 | A | 1/1940 | Moen | |
| 2,211,663 | A * | 8/1940 | Lefevre | 16/374 |
| 3,002,582 | A | 10/1961 | Marcelis | |
| 3,318,413 | A | 5/1967 | Werner et al. | |
| 3,327,385 | A | 6/1967 | Shaver | |
| 3,692,143 | A | 9/1972 | Kummerlin et al. | |
| 3,811,151 | A | 5/1974 | Kuemmerlin | |
| 3,849,834 | A | 11/1974 | Mayer | |
| 3,858,684 | A | 1/1975 | Goings | |

(Continued)

FOREIGN PATENT DOCUMENTS

| | | |
|---|---|---|
| DE | 195 39 157 A1 | 4/1997 |
| EP | 0 324 885 A1 | 7/1989 |

(Continued)

OTHER PUBLICATIONS

PCT Internatinal Search Report dated Jul. 19, 2004.

*Primary Examiner* — Alvin Chin Shue
(74) *Attorney, Agent, or Firm* — Holland & Hart, LLP

(57) ABSTRACT

Ladder configurations and components are provided including an outer rail assembly which is longitudinally adjustable relative to an inner rail assembly. The outer rail assembly may include a pair of spaced apart outer rails each fixedly coupled to an associated sleeve or sliding mechanism. Each sleeve is in turn slidably coupled to an inner rail of the inner rail assembly. The outer rails may be positioned and oriented at an acute angle relative to the inner rails so as to provide an increased base distance between the two outer rails. Support structures are also disclosed which are coupled at multiple locations along a rail member and at least one location of a rung. Additionally, ladder hinges are disclosed including hinge components configured to effectively transmit loads from associated rails. In one embodiment the hinge may include a pinch prevention mechanism.

15 Claims, 17 Drawing Sheets

U.S. PATENT DOCUMENTS

| | | | | | |
|---|---|---|---|---|---|
| D248,777 | S | | 8/1978 | Spencer et al. | |
| RE30,020 | E | | 6/1979 | Spencer et al. | |
| 4,182,431 | A | | 1/1980 | Wing | |
| 4,210,224 | A | | 7/1980 | Kummerlin et al. | |
| 4,371,055 | A | | 2/1983 | Ashton et al. | |
| 4,376,470 | A | * | 3/1983 | Ashton | 182/23 |
| 4,407,045 | A | * | 10/1983 | Boothe | 16/329 |
| 4,474,264 | A | | 10/1984 | Krause | |
| 4,540,306 | A | | 9/1985 | Wang | |
| 4,566,150 | A | | 1/1986 | Boothe | |
| 4,597,687 | A | | 7/1986 | Colas | |
| 4,656,721 | A | | 4/1987 | Werner | |
| 4,697,305 | A | | 10/1987 | Boothe | |
| 4,698,896 | A | | 10/1987 | Osterwald et al. | |
| 4,773,503 | A | | 9/1988 | Purkapile | |
| 4,890,950 | A | | 1/1990 | Yoo | |
| D309,502 | S | | 7/1990 | Wing et al. | |
| 4,947,959 | A | * | 8/1990 | Yuen | 182/22 |
| 4,951,780 | A | * | 8/1990 | Kim | 182/27 |
| 4,967,879 | A | | 11/1990 | Klafs et al. | |
| 4,974,701 | A | | 12/1990 | Parise | |
| 5,002,153 | A | | 3/1991 | Yuen | |
| 5,022,118 | A | * | 6/1991 | Wan-Li | 16/327 |
| 5,279,387 | A | | 1/1994 | Swiderski et al. | |
| 5,305,851 | A | | 4/1994 | Katson et al. | |
| 5,353,892 | A | | 10/1994 | Lu | |
| 5,359,812 | A | | 11/1994 | Mayfield | |
| 5,366,051 | A | | 11/1994 | Bartnicki et al. | |
| 5,419,084 | A | | 5/1995 | Sankey et al. | |
| 5,515,942 | A | | 5/1996 | Woodfield | |
| 5,590,739 | A | | 1/1997 | High et al. | |
| 5,954,157 | A | | 9/1999 | Grimes et al. | |
| 5,966,777 | A | | 10/1999 | Jantschek | |
| 6,032,759 | A | | 3/2000 | Yeh | |
| 6,141,909 | A | | 11/2000 | Hanson | |
| 6,220,389 | B1 | | 4/2001 | Krause | |
| 6,269,909 | B1 | | 8/2001 | Grimes et al. | |
| 6,298,605 | B1 | | 10/2001 | Delefosse et al. | |
| 6,343,406 | B1 | | 2/2002 | Yeh | |
| 6,533,882 | B1 | | 3/2003 | Woodside | |
| 6,698,550 | B2 | | 3/2004 | Crain | |
| 6,866,117 | B2 | * | 3/2005 | Moss | 182/23 |
| 7,047,597 | B2 | | 5/2006 | Lee | |
| 2003/0188923 | A1 | | 10/2003 | Moss | |
| 2004/0206006 | A1 | * | 10/2004 | De La Coeur et al. | 49/383 |

FOREIGN PATENT DOCUMENTS

| | | |
|---|---|---|
| NL | 1002235 | 8/1997 |

* cited by examiner

COMBINATION LADDER, LADDER COMPONENTS AND METHODS OF MANUFACTURING SAME

CROSS-REFERENCE TO RELATED APPLICATIONS

This application is a continuation application of U.S. patent application Ser. No. 12/111,891, now U.S Pat. No. 8,069,948, filed Apr. 29, 2008, and issued on Dec. 6, 2011, which is a divisional of Ser. No. 10/706,308 U.S. Pat. 7,364,017, filed on Nov. 11, 2003, and issued on Apr. 29, 2008, which patent claims the benefit of U.S. Provisional Patent Application Ser. No. 60/425,449, filed Nov. 11, 2002 for COMBINATION LADDERS, LADDER COMPONENTS AND METHODS OF MANUFACTURING SAME, the disclosures of each of which are incorporated herein by reference in their entireties.

BACKGROUND OF THE INVENTION

1. Field of the Invention

The present invention relates generally to ladders, ladder systems and ladder components and, more specifically, to combination ladder rail configurations, ladder support structures, ladder hinge configurations and methods of manufacturing the same.

2. State of the Art

Ladders are conventionally used to provide a user thereof with improved access to locations that might otherwise be inaccessible. Ladders come in many shapes and sizes, such as straight ladders, straight extension ladders, step ladders, and combination step and extension ladders. So-called combination ladders are particularly useful because they incorporate, in a single ladder, many of the benefits of other ladder designs.

However, the increased number of features provided by a combination ladder also brings added complexity and manufacturing difficulties in producing such a ladder. Additionally, the incorporation of additional features in a ladder often leads to an increase in the weight of a given ladder or ladder system. Generally, since ladders are used as portable tools, added weight is often an undesirable attribute in ladders. Further, since a combination ladder may be used in various configurations and, thus, experience various loading conditions, the ladder's components may require higher strength materials or may need to be increased in size over a conventional non-combination ladder to accommodate such loading requirements. Thus, combination ladders or ladder systems may ultimately cost more and/or weigh more than conventional ladders or ladder systems.

For example, in order to support a combination ladder, the lower portions of the outer side rails are conventionally flared by bending a lower portion of the outer side rails outwardly so as to increase the lateral distance therebetween. While such a configuration serves to increase the stability of the ladder, successfully forming the flared outer side rails presents various manufacturing complexities. For example, if the outer rails are formed with a conventional fiberglass composite material, the bending of such members may result in weakening or potential breakage of individual fiberglass strands and, ultimately, lead to the premature failure of the outer rail in which the bend is formed.

In order to form a bent side rail which is fabricated from conventional fiberglass composite materials and which meets quality and structural design requirements, the side rail may need to be molded including the individual placement of fibers within the mold. Such a process is both labor and time intensive. For example, in order to provide sufficient strength in such outer side rails, U.S. Pat. No. 4,371,055 to Ashton et al. discloses a manufacturing method in which fibers are angularly oriented relative to a longitudinal axis of the resulting side rail. However, as noted above, such a method requires a time and labor intensive molding process and, additionally, requires the use of custom molds. Even in the case of forming a bend in metal side rails, additional equipment is required to properly form such a bend without impairing the structural integrity of the components.

Another concern in the manufacture of a combination ladder, or any ladder, is providing the ladder with sufficient rigidity. In other words, the side rails and other ladder components should not exhibit excessive deflection, either in bending or in torsion, while under loaded conditions. One prior art approach for improving the rigidity of a ladder includes providing a support brace that extends, for example, between the lower side rails and attaches to a rear face of each. Thus, when a ladder experiences loading, a portion of the loading may be transmitted to such brace, helping to maintain the two side rails from becoming displaced outwardly from one another. Another prior art approach has been to provide a pair of braces, each of which extends between a lower rung of the ladder and a front wall or a rear wall of an outer rail of the ladder.

However, prior art support braces such as those described above conventionally include relatively long, thin strips of material. Such bracing is often susceptible to bending, twisting and buckling due to potential exposure and abuse of the bracing associated with the general handling, storing and transportation of the ladder. Additionally, such bracing may be obstructive, and thus pose a safety hazard, to the user of the ladder in certain instances.

Yet another difficulty in designing and manufacturing a combination ladder involves the hinges of such a ladder. Prior art approaches for simplifying ladder hinges have included the use of multiple plates to form the primary structural elements of the hinge. The multiple plates may be positioned within the hollow portion of a side rail and then fixed therein such as by rivets or similar fasteners. However, as the user of the ladder applies a force to the side rail, such as in changing the configuration of the ladder from a step ladder to an extension ladder, the force is transmitted to the hinge member in large part through the fasteners (e.g., the rivets). The fasteners thus become a critical structural element of the ladder and are susceptible to fatigue and wear due to the cyclical loads applied thereto.

Considering the desire to maintain or decrease the cost, weight, and complexity of combination ladder systems while maintaining, or even improving, the structural soundness of such ladder systems, it would be advantageous to provide a ladder system having, for example, improved hinge mechanisms, support structures, and extension rail configurations.

BRIEF SUMMARY OF THE INVENTION

In accordance with one aspect of the present invention, a rail assembly for a ladder is provided. The rail assembly includes an inner rail assembly comprising a first inner rail and a second inner rail spaced apart from the first inner rail a first distance and substantially parallel to the first inner rail. The inner rail assembly further includes at least one inner rung extending between and coupled to the first and second inner rails. Additionally, a first discrete sleeve is positioned adjacent the first inner rail and is slidable along at least a portion of a length of the first rail. Likewise, a second discrete sleeve is positioned adjacent the second inner rail and is slidable along at least a portion of a length of the second rail. A first outer rail has a first end thereof fixedly coupled to the first sleeve, and a second outer rail has a first end thereof fixedly coupled to the second sleeve. At least one outer rung extends between and is coupled to the first and second outer rails. A second distance is defined that extends between a second end of the first outer rail and a second end of the second outer rail wherein the second distance is greater than the first distance measured between the first and second inner rails.

The sleeve configuration as described above also may allow the inner rails to be positioned relative to the outer rails so that the ladder height may be increased or reduced, and thus, may facilitate the extension capability of a combination ladder. Therefore, the sleeve configuration may allow an engagement mechanism to selectively and reversibly affix the inner rails to the outer rails, so that the ladder may be used in a number of different conditions. For example, engagement of an inner and proximate outer side rail to one another may be accomplished by way of a removable pin extending through the outer side rail and sleeve affixed thereto and into an aperture within the inner rail so that the inner rail may be engaged to the sleeve and outer side rail proximate thereto.

As a further aspect of the present invention, a support structure may be disposed to support the lower portion of an outer rail. The support structure may be configured to attach the lower rung of the ladder to the rail at two or more mutually remotely spaced locations. For example, a support element may affix the lowermost rung to the outer rail at a side or surface opposing the rung attachment side or surface of the rail at a first longitudinal position along the rail, and also to the opposing side or surface of the rail at a second longitudinal position along the rail. Such a configuration may provide greater strength, rigidity and support for the outer rails, with increased resistance to bending and twisting thereof.

In another aspect of the present invention, a pair of hinge components may form the major structural foundation for a ladder hinge assembly. More specifically, a first hinge component having a hinge tongue may be affixed to a rail of a ladder, and a second hinge component having a hinge groove, for receiving the hinge tongue, may be affixed to another rail of a ladder. Further, each hinge component may also include a rail mount section with an outer periphery that substantially conforms to the inner periphery of the rail within which the hinge component is disposed.

Moreover, the first hinge component having a hinge tongue may serve as the primary load transmitting member between the inner rail affixed thereto and the selectable rotation positioning mechanism. Similarly, the second hinge component having a hinge groove may serve as the primary load transmitting member between the inner rail affixed thereto and the selectable rotation positioning mechanism. Such a configuration may be advantageous for ease of manufacturing and assembly.

Moreover, hinge blanks may be employed to fabricate the above-mentioned hinge components. For example, fabricating hinge blanks by way of extrusion, and then removing unwanted material to form hinge components may allow for flexibility of design, as well as reduced manufacturing costs. Further, each hinge blank may include a varied cross-sectional geometry including, for example, a first reinforcement segment, a second reinforcement segment and a web segment extending therebetween, wherein the first and second reinforcement segments (of each hinge component) both exhibit a cross-sectional thickness greater than the web segment.

In accordance with another aspect of the present invention, a ladder is provided that may include a hinge with a pinch prevention mechanism. This may include a first hinge component coupled to a first rail and a second hinge component coupled to a second rail. The second hinge component may be rotatably coupled with the first hinge component such that the first and second hinge components may be rotated between a first position and a second position. At least one protruding member is biased outwardly from the first hinge component when the first hinge component and the second hinge component are in the first position. The protruding member is located and configured to be displaced relative to the first hinge component when the first hinge component and the second hinge component are in the second position.

Other features and advantages of the present invention will become apparent to those of ordinary skill in the art through consideration of the ensuing description, the accompanying drawings and the appended claims.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
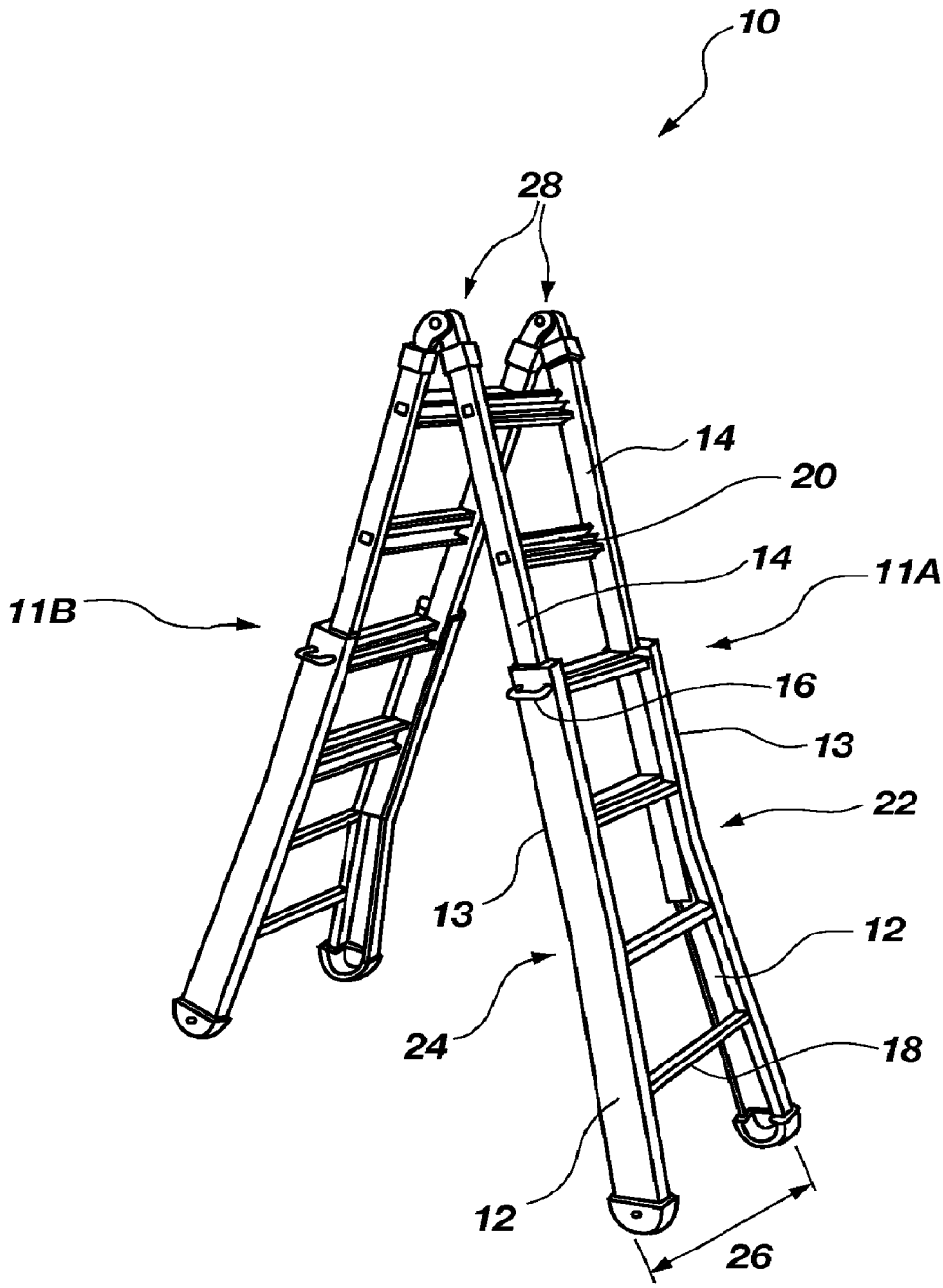
FIG. 1 (PRIOR ART)
FIG. 1 is a perspective view of a prior art combination ladder.

Referring to FIG. 1, a prior art combination ladder 10 is shown that includes first and second rail assemblies 11A and 11B respectively. Considering the first rail assembly 11A for sake of convenience, first rail assembly 11A includes a pair of outer rails 12 and a pair of inner rails 14. The outer rails 12 include an upper portion 13 that is configured to cooperatively mate with the inner rails 14 such that the inner rails 14 are slidable relative to outer rails 12 along a longitudinal axis defined by the inner rails 14. Thus, the inner rails 14 may be positioned in a generally vertical direction, relative to the outer rails 12, and selectively maintained at a given position by way of a releasable engagement mechanism 16. Such an arrangement enables the overall height of the ladder 10 to be adjusted as required or desired.

Outer rungs 18 extend between and are affixed to the outer rails 12. Similarly, inner rungs 20 extend between and are affixed to the inner rails 14. Outer rails 12 include a bent portion 22 that causes the lower portion 24 of each outer rail 12 to flare outwardly thereby increasing the base distance 26 of the outer rails 12 and adding to the overall stability of the ladder 10. Hinges 28 are coupled to the first and second rail assemblies 11A and 11B thereby allowing relative rotational positioning of the of the rail assemblies 11A and 11B. The relative rotational positioning of the rail assemblies 11A and 11B enables the ladder 10 to be configured as a straight ladder or as a step ladder depending on the requirements of the user and the task at hand. As set forth above herein, the formation of the bend or the bent portion 22 in the outer rails 12 often introduces various difficulties in manufacturing the outer rails 12. However, for safety reasons, and in order to meet certain industry standards, it may be necessary in some instances to flare the lower portions 24 of the outer rails 12 so as to provide a sufficient base distance 26 depending on the intended use of the ladder 10.

Figure 2:
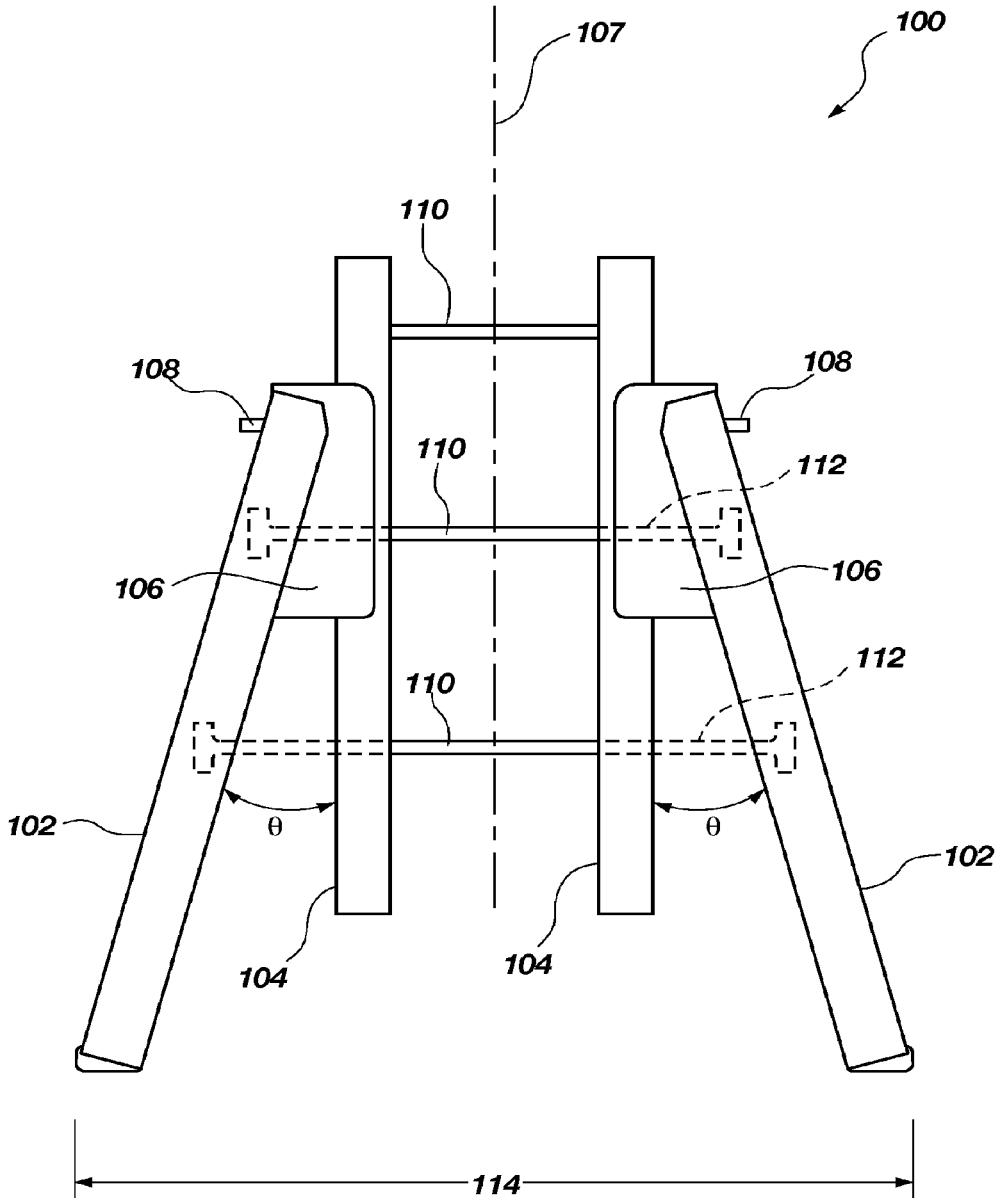
FIG. 2 is a front view of an inner and an outer rail assembly of the present invention.

Referring now to FIG. 2, a rail assembly 100 in accordance with an embodiment of the present invention is shown. The rail assembly 100 includes a pair of laterally spaced outer rails 102 and a pair of laterally spaced inner rails 104. The outer rails 102 and inner rails 104 are operably and slidably coupled to one another by means of discrete slide members 106, also referred to herein as sleeves. The sleeves 106 are fixedly coupled to associated outer rails 102 and are slidably coupled to associated inner rails 104. Thus, the sleeve members enable the outer rails 102 to be slidably displaced relative to inner rails 104 along a longitudinal axis 107, which is substantially parallel to the inner rails 104. A pair of releasable engagement mechanisms 108 are each associated with an outer rail 102, an inner rail 104 and a sleeve 106 so as to enable selective locking of the inner rails 104 at desired longitudinal positions relative to the outer rails 102 and sleeves 106.

Inner rungs 110 extend between and are coupled to inner rails 104. For example, an inner rung 110 may, in one embodiment, include a substantially tubular member that extends at least partially through an opening defined by an inner rail 104 having an end of the inner rung 110 swaged so as to fix the inner rung 110 to the inner rail 104. In other embodiments, the inner rungs 110 may be coupled to the inner rails 104 by rivets, adhesive bonding, welding, mechanical fasteners or a combination thereof depending, for example, on the type of materials used to form the inner rungs 110 and inner rails 104. Similarly, outer rungs 112, shown in dashed lines in FIG. 2 for purposes of clarity, extend between and are coupled to outer rails 102. The outer rungs 112 may be coupled to the outer rails 102 by an appropriate technique, including one or more of those set forth above. In one embodiment, the outer rungs 112 may be configured to include fastening tabs through which rivets or other appropriate mechanical fasteners may extend for coupling of the outer rungs 112 with the outer rails 102. In one particular embodiment, the fastening tabs may be integral with the rung such that they are formed as a unitary or monolithic member. Such rungs, and exemplary techniques of fastening such rungs, are disclosed in United States Application Publication No. US20030188923A1, filed Apr. 5, 2002, entitled LIGHT WEIGHT LADDER SYSTEMS AND METHODS, assigned to the Assignee of the present invention, the disclosure of which is incorporated herein by reference in its entirety.

The outer rails 102 may each include a substantially straight or linear member, as shown in FIG. 2, which is fixedly attached to its associated sleeve 106 at an acute angle θ relative to the longitudinal axis 107. With the outer rails 102 fixedly attached to the sleeves 106 at an acute angle θ, a desired base distance 114 between the outer rails 102 may be maintained without the need to form a bend in such outer rails as has been practiced in prior art ladders. Such a configuration provides a structurally sound ladder with a substantial reduction in manufacturing costs.

Additionally, by forming the outer rails 102 as substantially straight or linear members, greater flexibility is obtained in designing the cross-sectional shape of the outer rails 102. Such added flexibility enables the outer rails 102 to be designed for reduction in weight, increase in strength, etc., without having to consider the potential structural effects of a bend placed in such outer rails 102. By way of example, outer rails 102 (as well as inner rails 104) may be configured to exhibit hollow, C-shaped, or I-shaped cross-sectional shapes. Additionally, outer and inner rails 102 and 104 may be fabricated from various materials including, for example, composite materials including fiberglass, metals, such as aluminum, or metal alloys.

With respect to the use of composite materials, outer and inner rails 102 and 104 may be manufactured from a fiberglass composite material that may include, for example, a thermoset resin such as a polyurethane, although other thermoset polymer resins may be employed. The use of, for example, a polyurethane resin provides more durable outer and inner rails 102 and 104, particularly with respect to fracture- and impact-resistance. Furthermore, the use of, for example, a polyurethane resin, allows for thinner walled structural members (e.g., outer and inner rails 102 and 104), thereby enabling the fabrication of a ladder having substantial weight reduction over prior art ladders. Additionally, the outer and inner rails 102 and 104 may be formed by a pultrusion process such as set forth in United States Application Publication No. US20030188923A1. Particularly, strands of reinforcing material may be pulled through a bath of, for example, polyurethane resin, and then through a heated die that exhibits the desired cross-sectional shape of the outer or inner rail 102 or 104. As the composite material is pulled through the heated die, a partial cross-linking may be effected within the thermoset resin such that the material retains the shape of the die upon removal therefrom.

As noted above, the present invention enables both the inner rails 104 and the outer rails 102 to be formed as substantially straight members if so desired. However, it is noted that the outer rail 102 need not be formed as a substantially straight member in all instances. Additionally, while outer rails 102 are shown in FIG. 2 to be configured as a single member, the outer rails 102 may be formed of multiple members rigidly fixed to one another if so desired. However, for purposes of manufacturing simplicity and structural soundness, it may be desirable to form the outer rails 102 as a single member such as shown.

It is also noted that the term straight, as used herein with respect to outer and inner rails 102 and 104, allows for variation in cross-sectional shape or cross-sectional thickness of the outer and inner rails 102 and 104 along their respective lengths. Additionally, the term linear or straight, as used herein with respect to outer and inner rails 102 and 104 allows for reasonable manufacturing tolerances as will be appreciated by one of ordinary skill in the art.

Figure 3A:
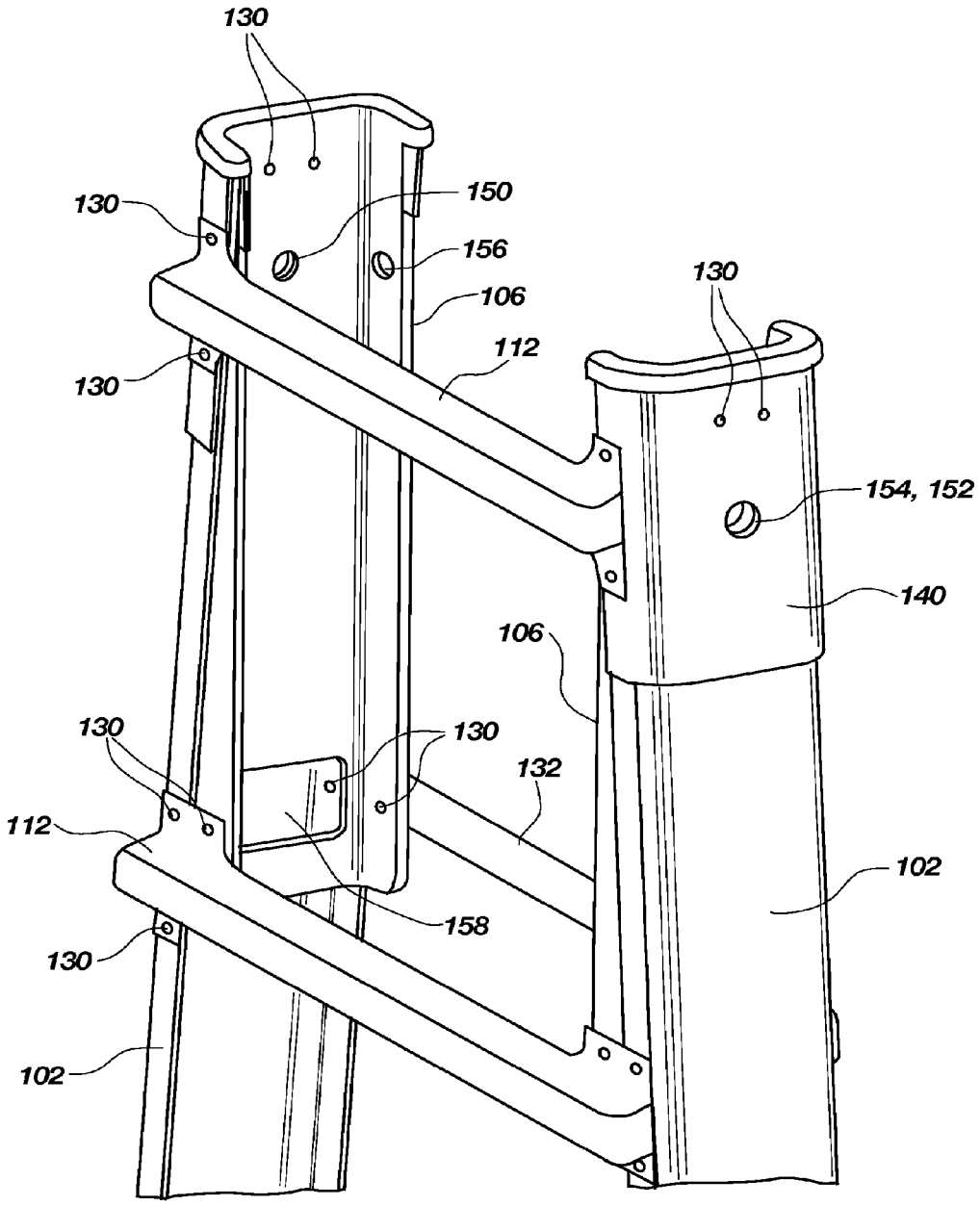
FIG. 3A is a front perspective view of a sleeve and an outer rail assembly according to an embodiment of the present invention.
Figure 3B:
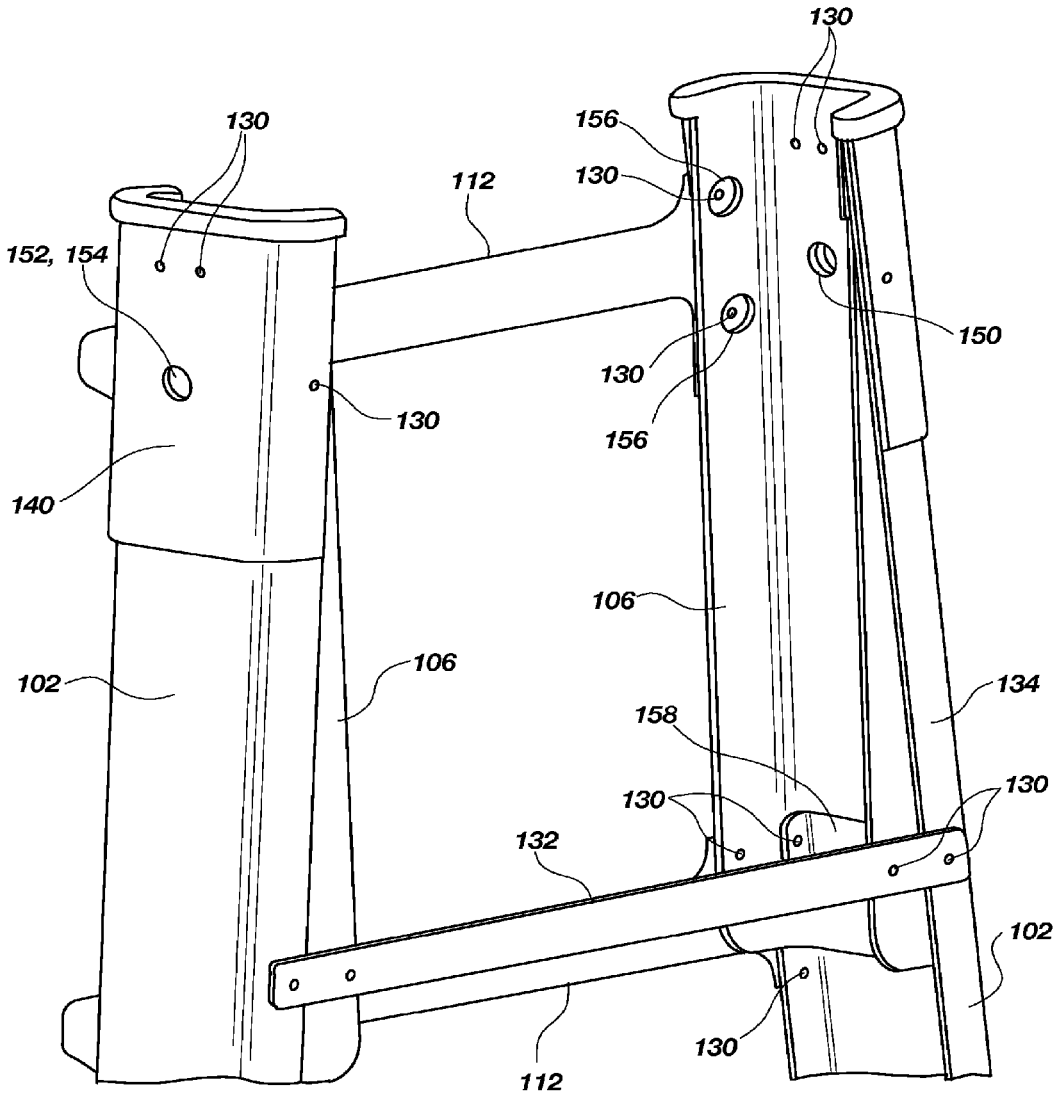
FIG. 3B is a rear perspective view of the sleeve and outer rail assembly shown in FIG. 3A.
Figure 3C:
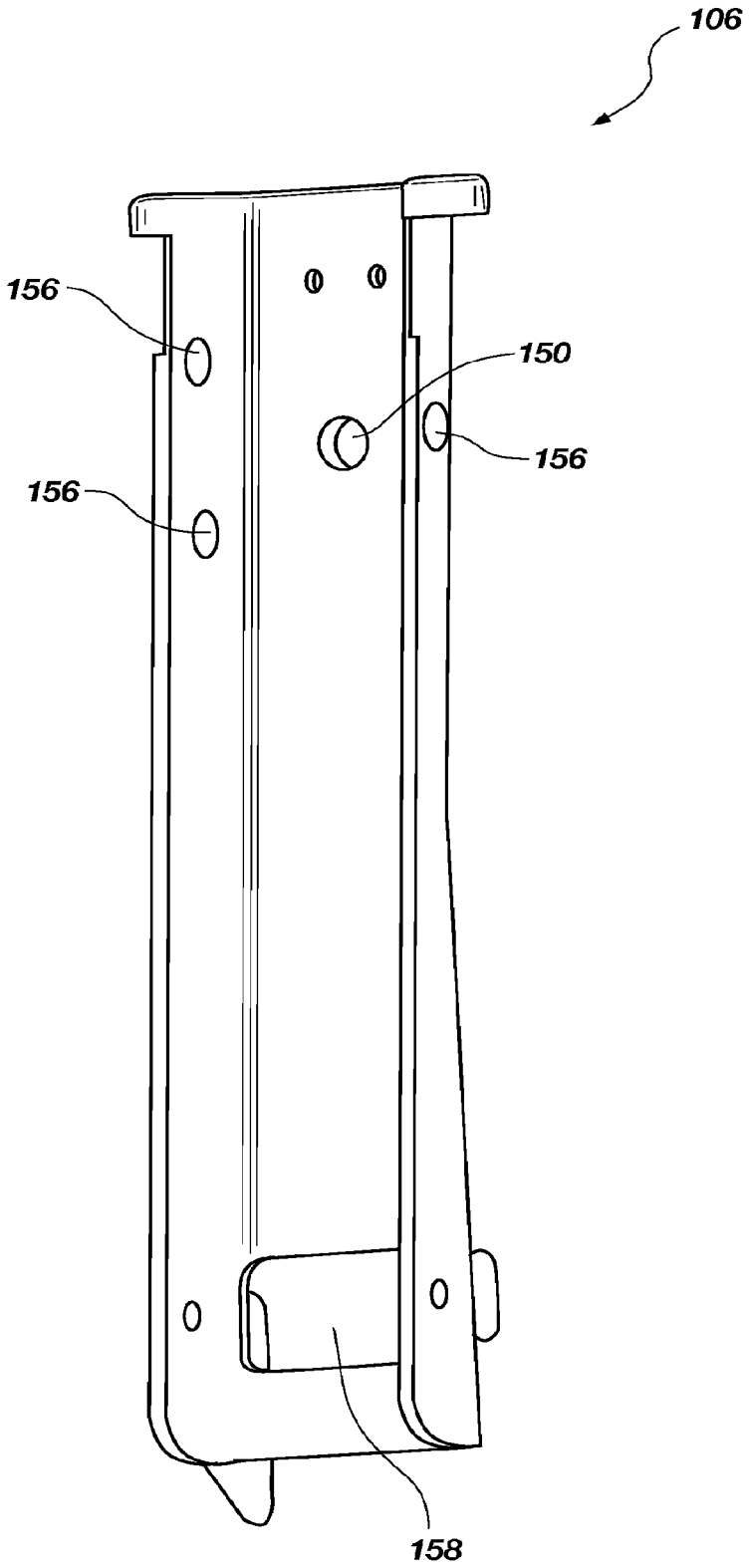
FIG. 3C is a perspective view of the sleeve shown in FIGS. 3A and 3B.

Referring now to FIGS. 3A through 3C, perspective views of outer rails 102 and sleeves 106 are shown with FIGS. 3A and 3B showing front and rear perspectives, respectively, of the sleeves 106 coupled to the outer rails 102 (inner rails 104 not shown in FIGS. 3A and 3B for clarity). Outer rungs 112 extend between outer rails 102 and are longitudinally spaced from one another. Each outer rung 112 attaches to the outer rails 102 via connection elements 130. Connection elements may comprise, for example, rivets, screws, bolts, pins, welds, adhesives, or other attachment mechanisms as known in the art. In the embodiment shown in FIGS. 3A and 3B, outer rails 102 are configured to exhibit a substantially C-shaped cross-section taken in a direction substantially normal to their respective lengths. The sleeves 106 may be configured to cooperatively mate within the C-shaped longitudinal channel defined by the outer rails 102.

A support member 132 may extend between and be attached to each of the outer rails 102 as well as the sleeves 106 by way of connection elements 130. As shown in FIGS. 3A and 3B, the support member 132 may be located on the rear face 134 of the outer rails 102, generally opposite where an outer rung 112 is attached, such that the support member 132 does not interfere with or otherwise act as an obstruction to a user of the ladder. A wear plate 140 may be formed about the outer rail 102 in the general location of the releasable engagement mechanism 108 (not shown in FIGS. 3A-3C for clarity, see FIG. 2) to protect the outer rails 102 from wear associated with repeated interaction of the engagement mechanism with the outer rails 102. Apertures 150 in sleeves 106 may be aligned with apertures 152 in the outer rails 102 and apertures 154 in wear plate 140 to accommodate, for example, insertion and retraction of a biased pin associated with the engagement mechanism 108 (FIG. 2). Such apertures 150, 152 and 154 may then be selectively aligned with similar apertures formed in the inner rails 104 (FIG. 2) for selectively positioning and locking the inner rails 104 with respect to the outer rails 102 and associated sleeves 106.

Additional apertures 156 and 158 may be formed in the sleeves 106 at various locations for tooling and/or assembly purposes. For example, such apertures 156 and 158 may provide access to connection elements 130 during assembly of the ladder. Referring to apertures 156, in another embodiment, such apertures 156 may be sized and configured to physically and mechanically interact with the connection elements 130 rather than simply allow access thereto.

It should be noted that the variously described features of the sleeves 106 in FIGS. 3A-3C are labeled with like reference numerals for ease of illustration and description. However, it is also noted that such sleeves 106 are actually depicted as being "left-hand" and "right-hand" configurations that are substantially mirror images of one another. However, the design of sleeves 106 may be identical such that only a single configuration (i.e., the sleeves 106 not being "right-hand" or "left-hand" specific) is provided if desired. Doing so may reduce inventory and also simplify associated manufacturing processes such as, for example, by eliminating the need for different molds or machining patterns used to manufacture the sleeves 106.

Figure 4A:
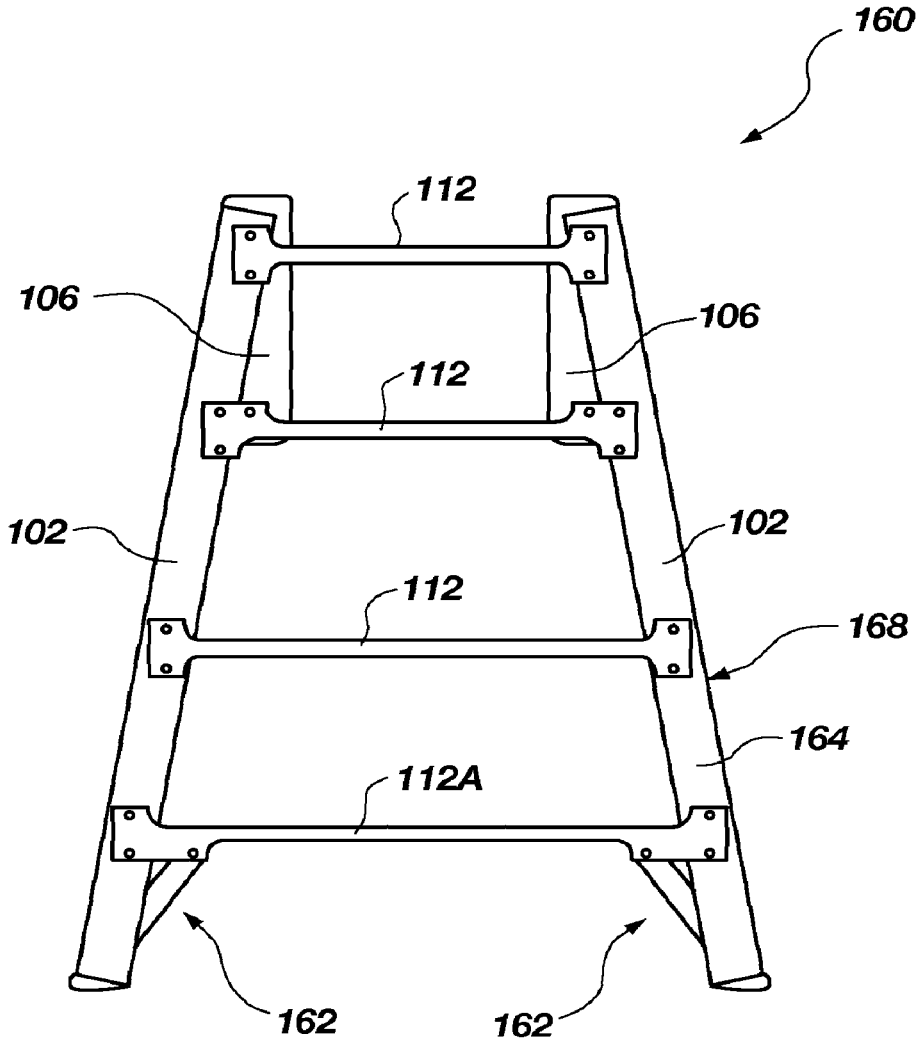
FIG. 4A is a front view of an outer rail assembly according to an embodiment of the present invention.
Figure 4B:
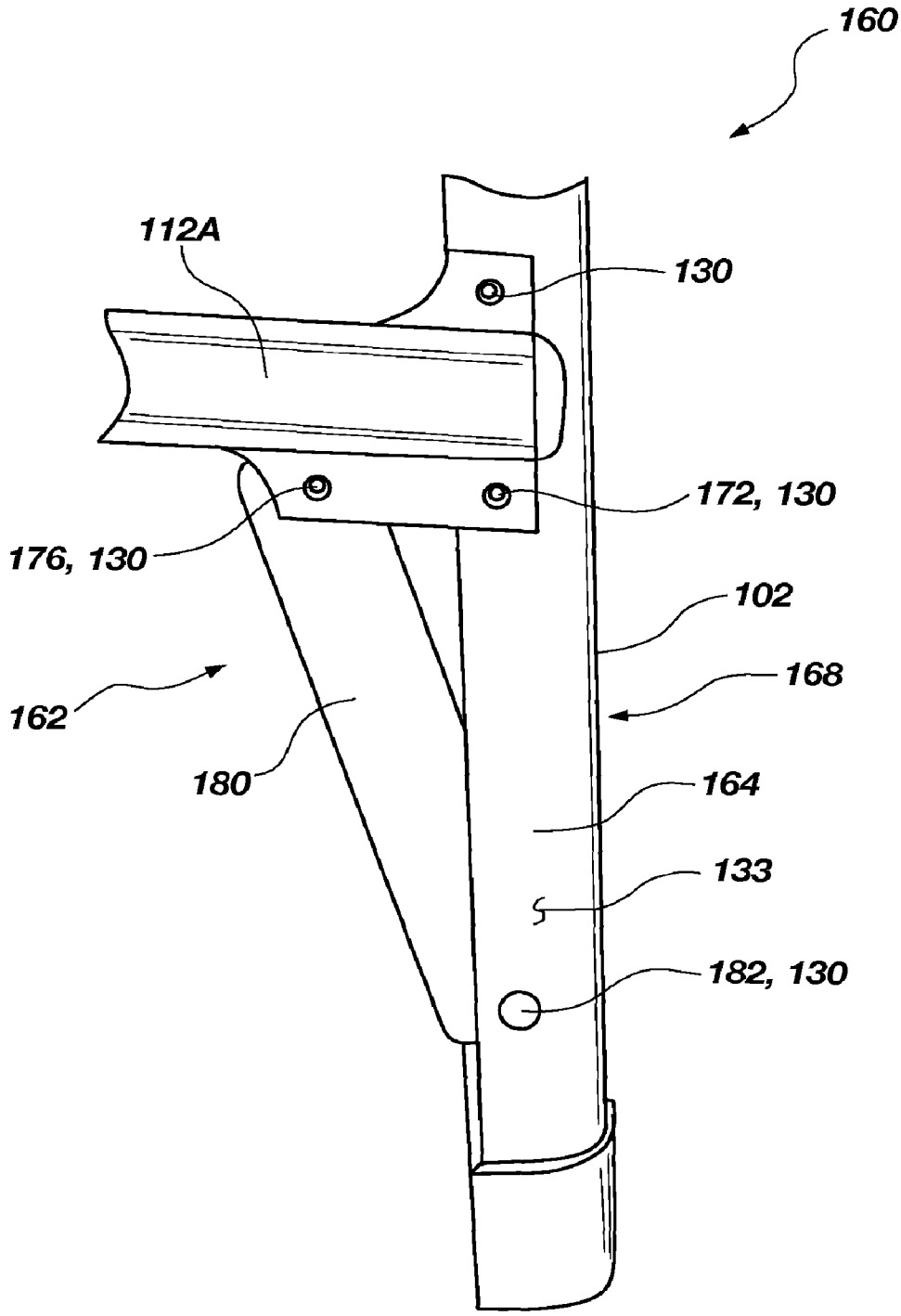
FIG. 4B is an enlarged front view of the support structure shown in FIG. 4A.
Figure 4C:
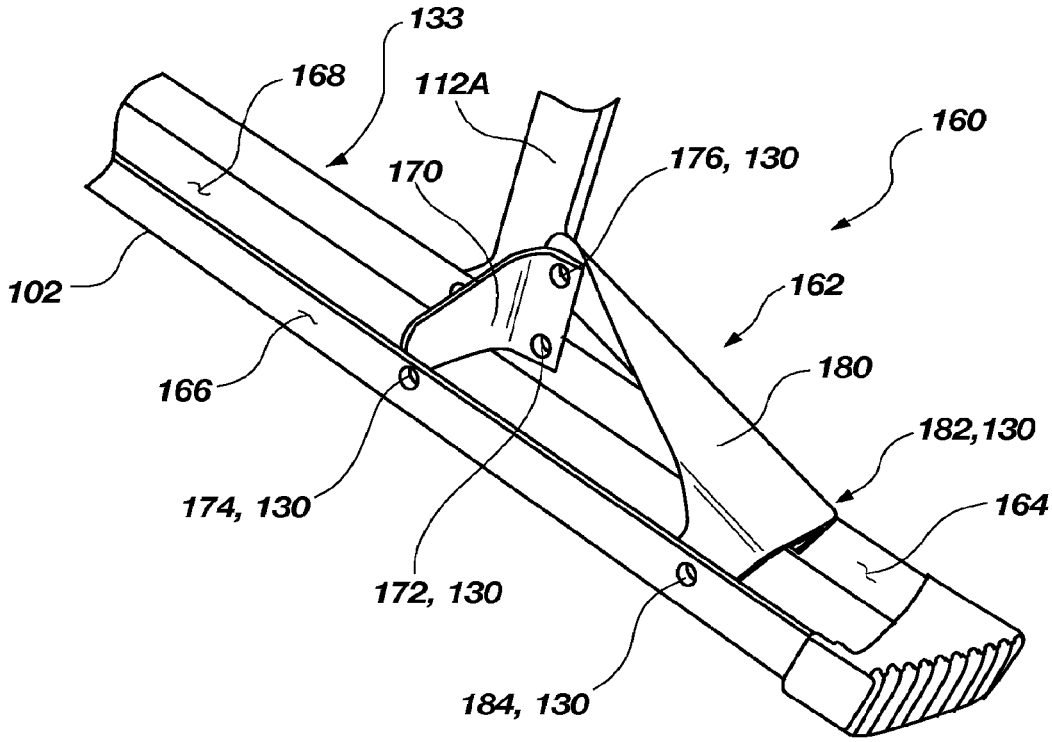
FIG. 4C is a perspective view of the support structure shown in FIGS. 4A and 4B.

Referring now to FIGS. 4A-4C, an outer rail assembly 160 is shown that may include outer rails 102, sleeves 106 and outer rungs 112 extending between the outer rails 102 and attached to a front face 133 of each. Support structures 162 may be used to improve the bending and/or torsional strength of the outer rails 102 by structurally connecting the lowermost outer rung 112A, at a location laterally spaced from the outer rail 102, to multiple locations along the outer rail 102.

Referring more specifically to FIGS. 4B and 4C, the outer rail 102 may exhibit a generally C-shaped cross-sectional configuration including a first wall 164 on the rung side and an opposing wall 166 laterally displaced from the first wall 164. The first wall 164 and opposing wall 166 are joined together by a common side wall 168. A first support element or brace 170 is fixed to the first wall 164 at location 172 and to the second opposing wall 166 at location 174. Additionally, the first brace 170 is fixed to the lowermost rung 112A at a location 176 that is laterally inwardly spaced from the outer rail 102. The first brace 170 may be fixed at the specified locations by connection elements 130 such as those described hereinabove.

Further, a second support element or brace 180 may be affixed to the first wall 164 at location 182 and the second opposing wall 166 at location 184 such as by connection elements 130. The second brace 180 is further fixed to the lowermost outer rung 112A at a location laterally inwardly displaced from the outer rail 102 such as at location 176. Such a configuration is advantageous in supporting both bending loads and torsion loads applied to the outer rails 102 by distributing an applied loading to various longitudinally spaced locations along the outer rail 102, including both sides of the outer rail 102 (i.e., the first wall 164 and second opposing wall 166) as well as to a laterally inwardly spaced location along the lowermost rung 112A. For example, utilizing cantilevered load bending tests as set forth in American National Standards Institute (ANSI) A14.2 (metal ladder), A14.5 (ladders formed of fiber reinforced plastic materials) and A14.10 (type IAA ladders with increased load ratings), the support structures according to the present invention reduce the amount of bending and torsion experienced by associated ladder rails as compared to existing support structures.

The support structure 162 of the present invention also distributes the applied loadings without extending an additional structural member between the two outer rails 102 that would likely be subject to abuse or might, in some instances, interfere with a user's climbing activities.

Figure 4D:
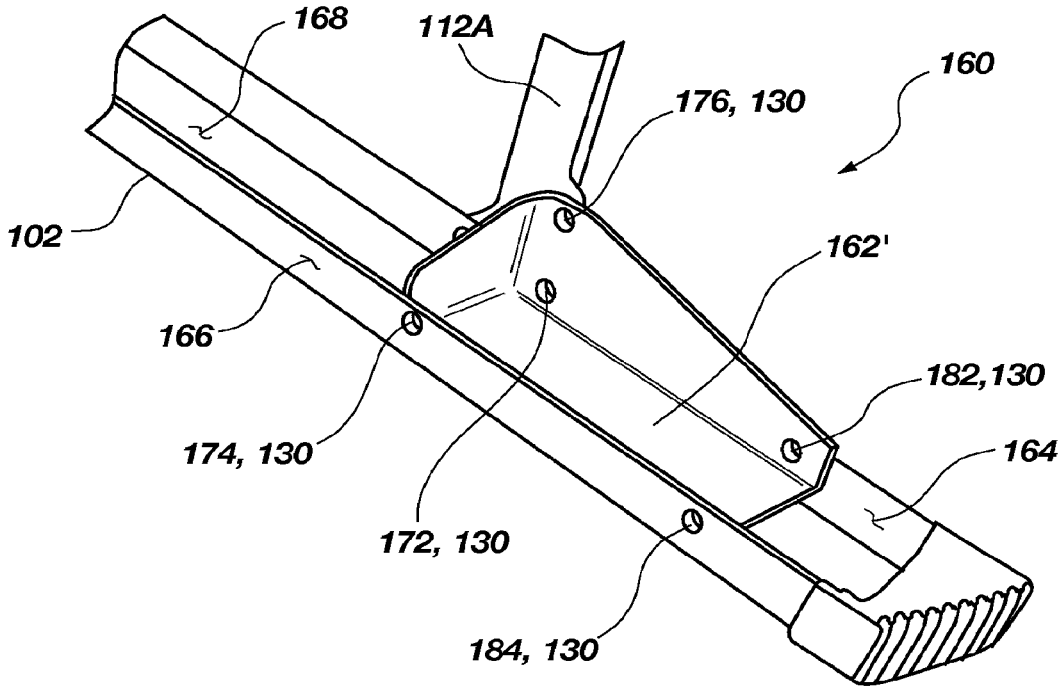
FIG. 4D is a perspective view of an alternate embodiment of a support structure of the present invention.

Referring briefly to FIG. 4D a support structure 162' is shown according to another embodiment of the invention. The support structure 162' may be formed as a somewhat partial C-shaped unitary member that fits within the longitudinally extending channel defined by the outer rail 102. The support structure 162' may be affixed to the outer rail 102 at locations 172, 174, 182 and 184 such as by connection elements 130 and as described above herein. The support structure 162' may also be fixed to the lowermost outer rung 112A at location 176 by a connection element 130. Thus, the support structure 162' provides similar structural support as that shown and described with respect to FIGS. 4A-4C, but through use of a unitary member that may be simpler and more economical to manufacture.

It is noted that, while the outer rails 102 shown and described with reference to FIGS. 4A-4D generally exhibit C-shaped cross-sectional areas, the present invention contemplates a wide array of geometries for ladder rails. For instance, outer rails 102 may be either substantially solid or hollow, rectangular, circular or partially circular, or the rails may exhibit the cross-sectional area of an I-beam. In such cases, the structural support 162, 162' may be complementarily shaped or otherwise configured for attachment to the outer rails 102 while still providing multiple mutually remotely located points of attachment therebetween.

Figure 5A:
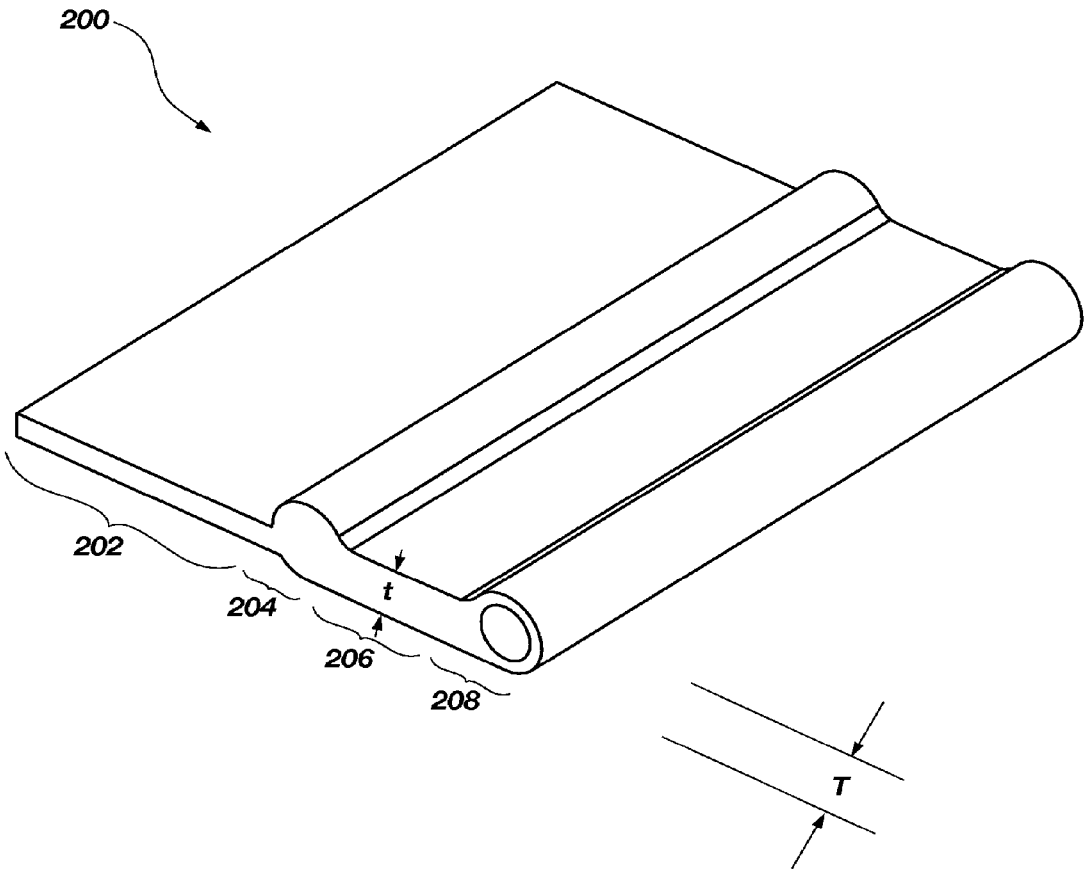
FIGS. 5A and 5B show perspective views of a hinge blank according to an embodiment of the present invention.
Figure 5B:
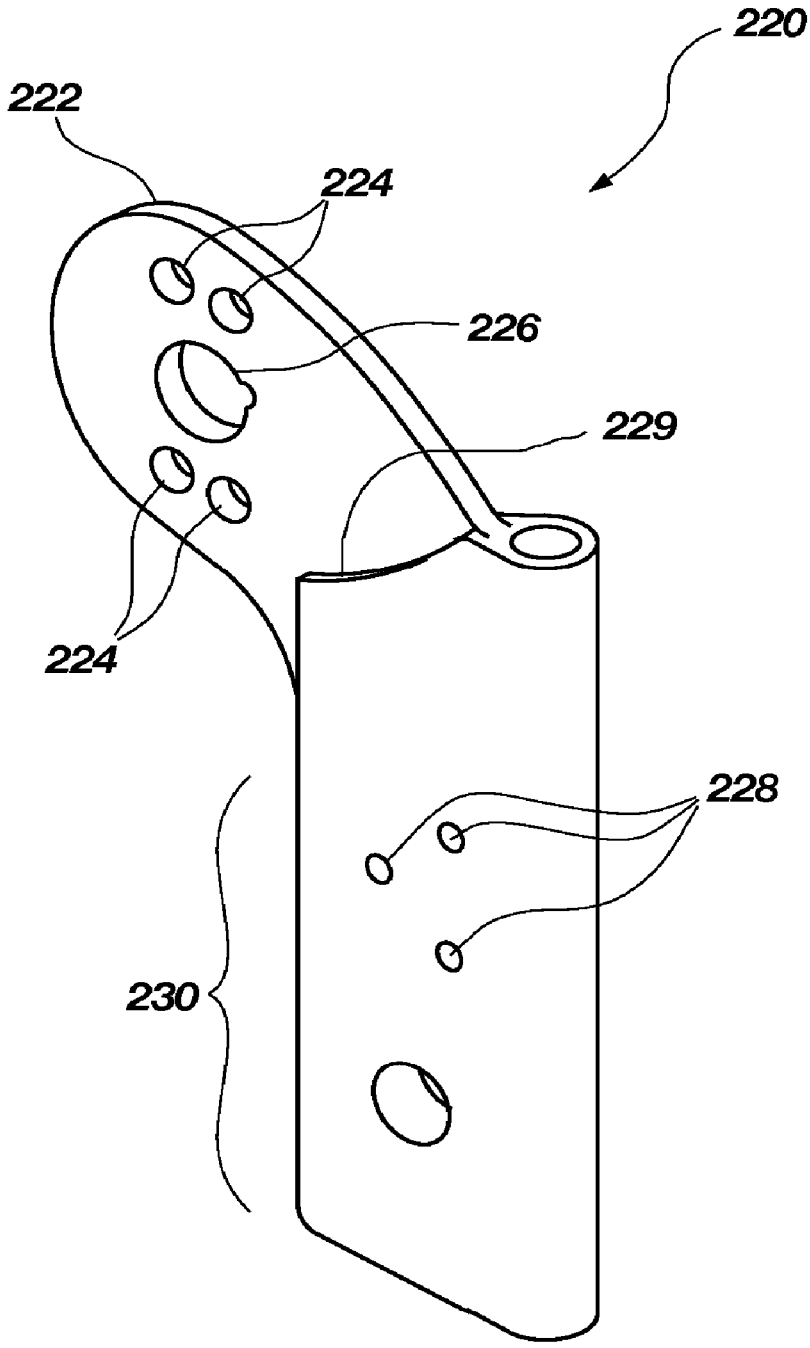

FIGS. 5A and 5B show a hinge blank 200 and a hinge component 220 formed therefrom, respectively. FIG. 5A shows a hinge blank 200 used in forming a hinge component having a hinge tongue. As shown in FIG. 5A, the hinge blank 200 may include a tongue segment 202, a first reinforcement segment 204, a web segment 206, and a second reinforcement segment 208. The first and second reinforcement segments 204 and 208 may desirably each exhibit a cross-sectional thickness "T" that is different, in this instance greater, than the cross-sectional thickness "t" of the web segment 206 extending therebetween. The hinge blank 200 may be formed of, for example, aluminum, by a process such as, for example, extrusion.

Referring now to FIG. 5B, a hinge component 220 is shown having a hinge tongue 222. The hinge component 220 may be formed from the hinge blank 200 such as by removing appropriate portions of hinge blank 200 (FIG. 5A) including the forming of locking apertures 224, pivot aperture 226, fastening apertures 228 and abutment shoulders 229 as shall be described in more detail below. Such removal material and shaping of the hinge component 220 may be accomplished by, for example, machining, milling, sawing, fluid jet cutting, or as otherwise known in the art.

Figure 7A:
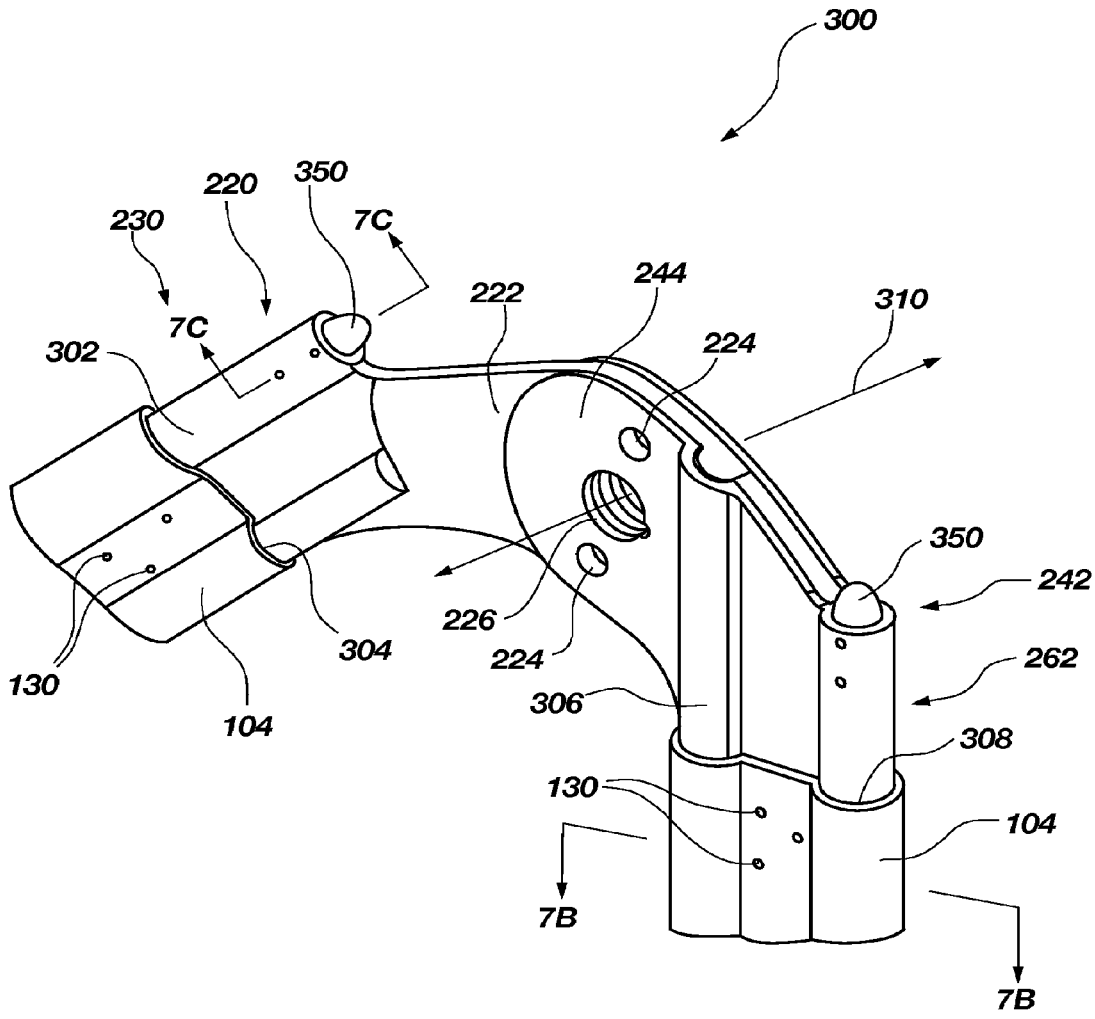
FIG. 7A is a perspective view of a hinge-rail assembly according to an embodiment of the present invention.
Figure 7B:
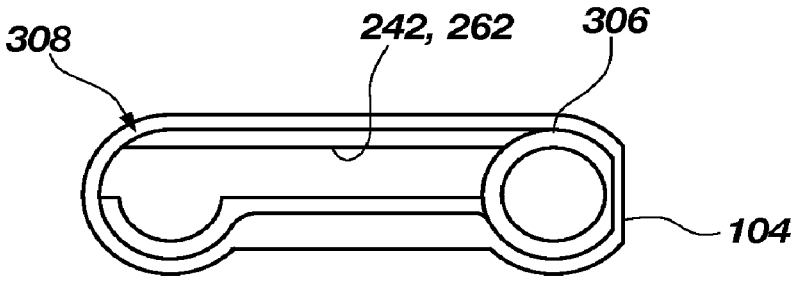
FIG. 7B is a cross-sectional view of the outer periphery of a rail mount section and the inner periphery of its corresponding rail of the hinge-rail assembly as shown in FIG. 7A.

The hinge component's lower section 230, also referred to herein as the rail mount section, is configured to be disposed within a rail component of a ladder (e.g., see inner rail 104 of FIGS. 2, 7A and 7B). The hinge component 220 may be longitudinally fixed within the rail component by way of appropriate connection elements such as, for example, rivets, bolts or screws disposed in the fastening apertures 228. As will be described in more detail below, the rail mount section 230 of hinge component 220 is configured to cooperatively and complementarily fit within a rail component (e.g., inner rail 104, FIG. 7A) of a ladder so that the outer periphery of the rail mount section 230 substantially conforms to, and interlocks with the inner periphery of such a rail.

Figure 6A:
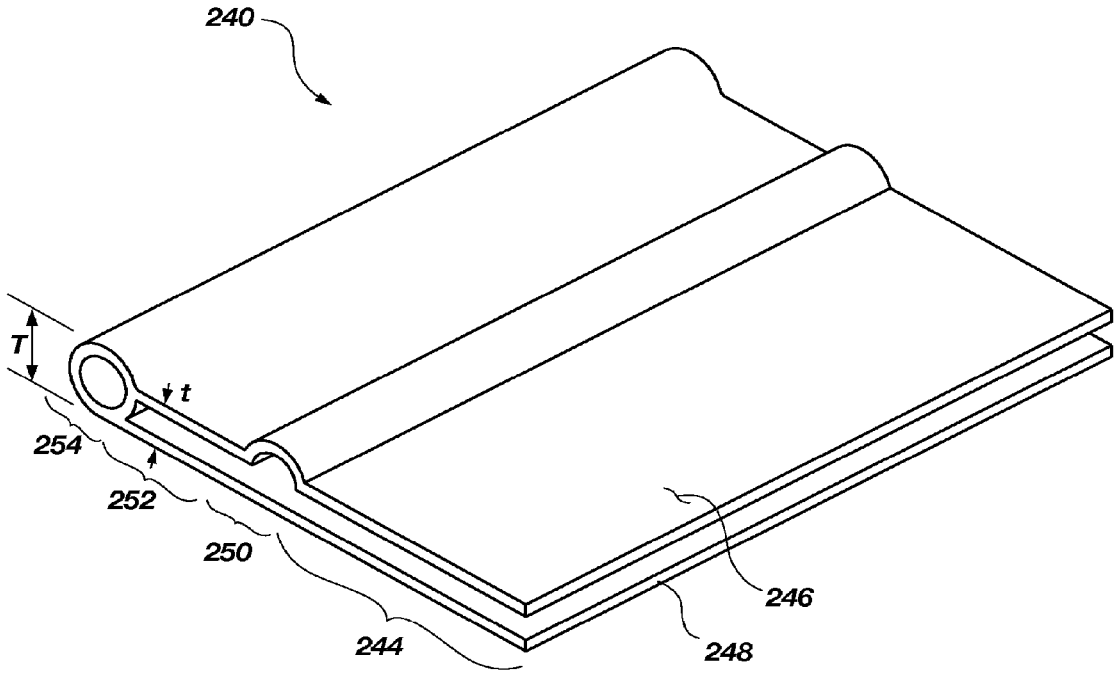
FIGS. 6A and 6B show perspective views of a hinge blank according to another embodiment of the present invention.
Figure 6B:
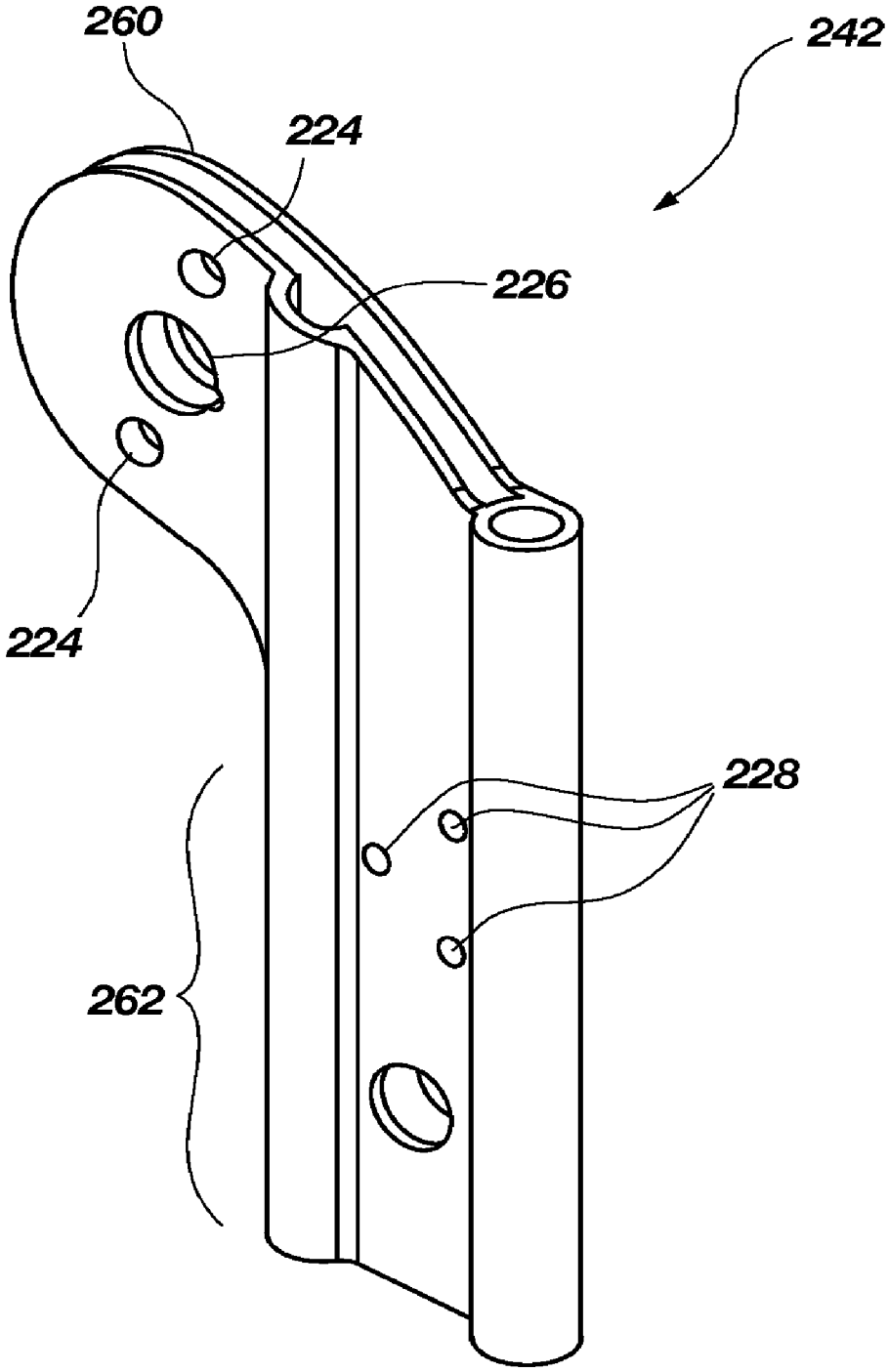

FIGS. 6A and 6B show another hinge blank 240 and a hinge component 242 formed therefrom, respectively. Referring first to FIG. 6A, the hinge blank 240 may include a grooved segment 244 comprised of a first plate segment 246 and second plate segment 248 that is spaced apart from, and substantially parallel with, the first plate segment 246. The hinge blank 240 further includes a first reinforcement segment 250, a web segment 252, and a second reinforcement segment 254. The first and second reinforcement segments 250 and 254 each exhibit a cross-sectional thickness "T" that is different from, in this instance greater than, the cross-sectional thickness "t" of the web segment 252 extending therebetween. The hinge blank 240 may be formed of, for example, aluminum, by a process such as, for example, extrusion.

Referring to FIG. 6B, the hinge component 242 may be formed by removing appropriate portions from the hinge blank 240 (FIG. 6A) including the forming of the hinge groove 260, locking apertures 224, pivot apertures 226 and fastening apertures 228 as shall be described in more detail below.

The hinge component's lower section 262, also referred to herein as the rail mount section, is configured to be disposed within a rail component of a ladder (e.g., see inner rail 104 of FIGS. 2, 7A and 7B). The hinge component 242 may be longitudinally fixed within the rail component with appropriate connection elements such as, for example, rivets, bolts or screws disposed in the fastening apertures 228. As will be described in more detail below, the rail mount section 230 of hinge component 220 is configured to cooperatively and complementarily fit within a rail component (e.g., inner rail 104, FIG. 7A) of a ladder so that the outer periphery of the rail mount section 262 substantially conforms to, and interlocks with, the inner periphery of such a rail.

As previously noted, the configuration of the hinge component 242, and more specifically the cross-sectional geometry of the rail mount section 262, may be advantageous for increasing strength of the resulting hinge while also reducing the overall weight of the ladder. For example, the first and second reinforcement segments 250 and 254 may provide additional section modulus for increased stiffness and strength within hinge component 242. Furthermore, as described in further detail below, the cooperative interlocking nature of the hinge component 242 with a rail to which it is mounted provides for greater structural soundness of the resulting ladder.

Turning now to FIG. 7A, a hinge assembly 300 is shown according to an embodiment of the present invention. The hinge assembly 300 includes a first hinge component 220 disposed within and affixed to an inner rail 104 and a second hinge component 242 also disposed within and affixed to an inner rail 104. As discussed above, the outer periphery 302 of the first hinge component's rail mount section 230 substantially conforms to and cooperatively mates with the inner periphery 304 of the inner rail 104. Similarly the outer periphery 306 of the second hinge components rail mount section 262 substantially conforms to the inner periphery 308 of the inner rail 104 to which it is mounted. The hinge tongue 222 of the first hinge component 220 fits within and matingly engages the grooved segment 244 of the second hinge component 242. A selectable hinge positioning and locking mechanism (not shown in FIG. 7A) may be disposed in the pivot apertures 226 enabling relative rotation of the first hinge component 220 and the second hinge component 242 about a defined axis 310 as will be appreciated by those of ordinary skill in the art. Additionally, the hinge positioning and locking mechanism may be used to selectively engage the locking apertures 224 of the first and second hinge components 220 and 242 thereby selectively locking the hinge assembly 300 in a desired rotational position.

It is noted that the configuration of the hinge assembly 300 including hinge components 220 and 242 exhibiting cross-sectional geometries of varied shapes and thicknesses that substantially conform with a mating inner rail 104, enables more efficient transfer of force from the inner rails 104 to the hinge components 220 and 242 when such components are rotated relative to one another. For example, without the interlocking effect achieved between the hinge components 220 and 242 and their associated inner rails 104, a force applied to one or both of the inner rails 104 in an effort to effect relative rotation of the hinge components 220 and 242 about the defined axis 310 would require that the force be transmitted through the connection elements 130. The repeated subjection of such connection elements 130 to the forces transmitted between the inner rails 104 and their associated hinge components 220 and 242 will eventually result in the fatigue and failure of the connection elements. Thus, by transmitting the force directly from the inner rails 104 to the hinge components 220 and 242, due to their cooperative interlocking relationship, the stress experienced by their associated connection elements 130 is reduced.

Referring briefly to FIG. 7B, a cross-sectional view of the hinge component 242 mounted within its associated inner rail 104 is shown according to one embodiment of the present invention. The outer periphery 306 of rail mount section 262 of hinge component 242 thus substantially conforms the inner periphery 308 of the rail 104 in an interlocking manner. It is noted that other cross-sectional geometries for hinge components may be utilized. For example, referring briefly to FIGS. 6A and 6B along with FIG. 7B, the first and second reinforcing segments 250 and 254 of the second hinge component 242 need not exhibit a substantially circular shape cross-sectional geometry. Additionally, the first reinforcing segment 250 need not exhibit the same cross-sectional geometry as the second reinforcing segment 254. Moreover, the web segment 252 need not include a surface that is substantially tangent with a surface of each reinforcing segment 250 and 254. Rather, in one exemplary embodiment, the web segment 252 may be configured such that it extends from each reinforcing segment 250 and 254 in a substantially radial relationship therewith forming a dog bone-type geometry. In any case, the interior cross-sectional geometry of the rail 104 may be sized and configured to substantially conform and cooperatively mate with the cross-sectional geometry of the hinge component's rail mount section 262.

Referring briefly to FIG. 2, another advantage of such cross-sectional geometries having a relatively thinner web segment 206, 252 includes the ability to attach an inner rung 110 to an inner rail 104 with a swaged connection, such as disclosed in U.S. patent application Ser. No. 10/117,767, now U.S. Pat. No. 6,866,117, to Moss, assigned to the assignee of the present invention, while maintaining adequate clearance between the swaged connection and the sleeves 106 and/or the outer rails 102 that slide relative thereto. Without such clearance, the cross-sectional geometry of the sleeves and/or outer rails 102 may have to be modified so as to not interfere with the connection between the inner rung 110 and inner rail 104.

Figure 7C:
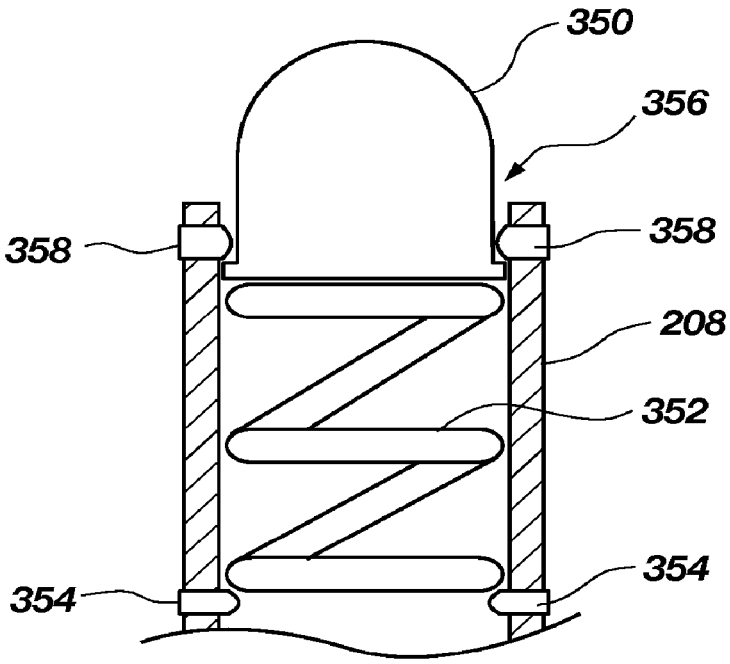
FIG. 7C is a partial cross-sectional view as indicated in FIG. 7A.

Referring back to FIG. 7A, the hinge assembly 300 may further include an antipinch mechanism. In the embodiment shown in FIG. 7A, the antipinch mechanism may include a biased protruding member 350 operably disposed within one or more of the structural reinforcement segments (e.g., 208, 250, 254 of FIGS. 5A and 6A) of the hinge components 220 and 242. For example, as shown in FIG. 7C, the antipinch mechanism may include a biasing member 352, such as a coil spring, disposed within a reinforcement segment 208 of a hinge component 220, the biasing member 352 having a lower end fixed to or abutting a first stopping member 354. The stopping member 354 may include, for example, a set screw, an indented portion of the reinforcement segment 208, a machined shoulder within the reinforcement segment or other similar structure as will be appreciated by those of ordinary skill in the art. A protruding member 350 may be disposed within the reinforcement segment 208 and biased such that the protruding member 350 protrudes out the upper end 356 of the reinforcement segment 208. Another stopping member 358 may be used to limit the longitudinal travel of the protruding member 350 such that at least a portion thereof remains within the reinforcement segment 208.

Figure 7D:
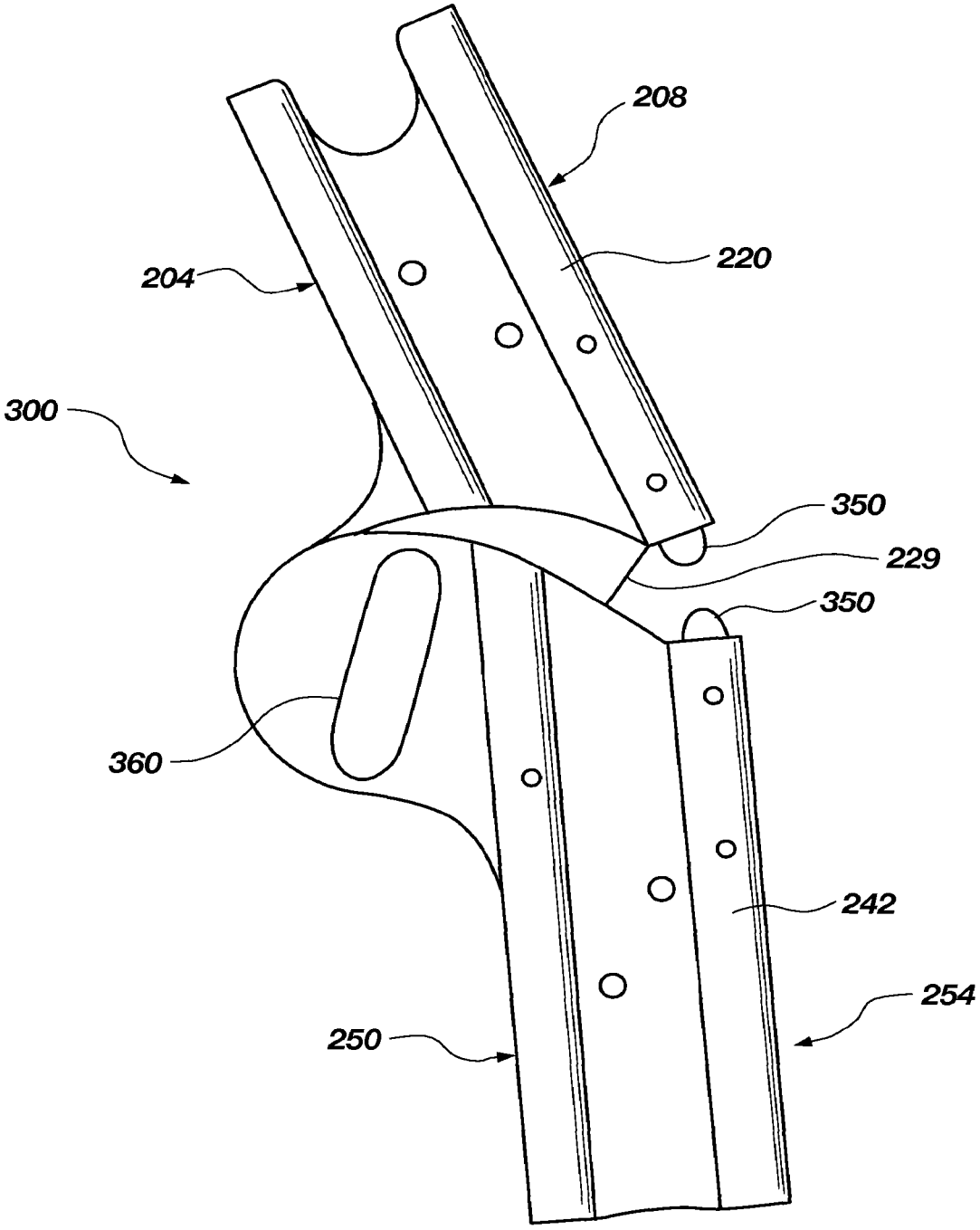
FIG. 7D is a perspective view of a hinge assembly according to an embodiment of the present invention.

Referring now to FIG. 7D, the hinge assembly 300 is shown in a rotated position that is between a first locking position (such as for a stored or a step ladder configuration) and a second locking position, also referred to herein as the closed position (such as for a straight ladder or extension ladder configuration). As discussed above, a selectable hinge positioning and locking mechanism 360 may be used to enable relative rotation of the first hinge component 220 and second hinge component 242 about a common axis, as well as for locking the hinge components 220 and 242 in a desired position relative to each other.

As the first and second hinge components 220 and 242 are rotated into abutment with each other (i.e., see FIG. 7E), the biased protruding members 350 will first come in contact with each other. The contact, or impending contact, of the two biased protruding members 350 provides a warning to the user of the ladder. For example, the two biased protruding members 350 may contact a user's hand or fingers and exert a mild force thereon, effected by the biasing members 352 (FIG. 7C) so as to alert the user that the hinge assembly 300 is rotating to a closed position. Such a warning allows the user to remove his hand or fingers prior to the hinge assembly completing its rotation to the closed position. Additionally, depending on the force provided by the biasing members 352 (see FIG. 7C), once the two biased protruding members 350 initially abut one another, an additional force may be required to effect the rotation of the hinge components 220 and 242 into the closed position.

While the embodiments shown in FIGS. 7A and 7D have been described with respect to two opposing biased protruding members 350 that rotate into and out of abutting contact with one another, it is noted that a single biased protruding member 350 may be used for a given hinge assembly 300. For example, the biased protruding member 350 may be located and configured to rotate into and out of abutting contact with a defined surface or a structural member of the opposing hinge component, as will be appreciated by those of ordinary skill in the art.

Figure 7E:
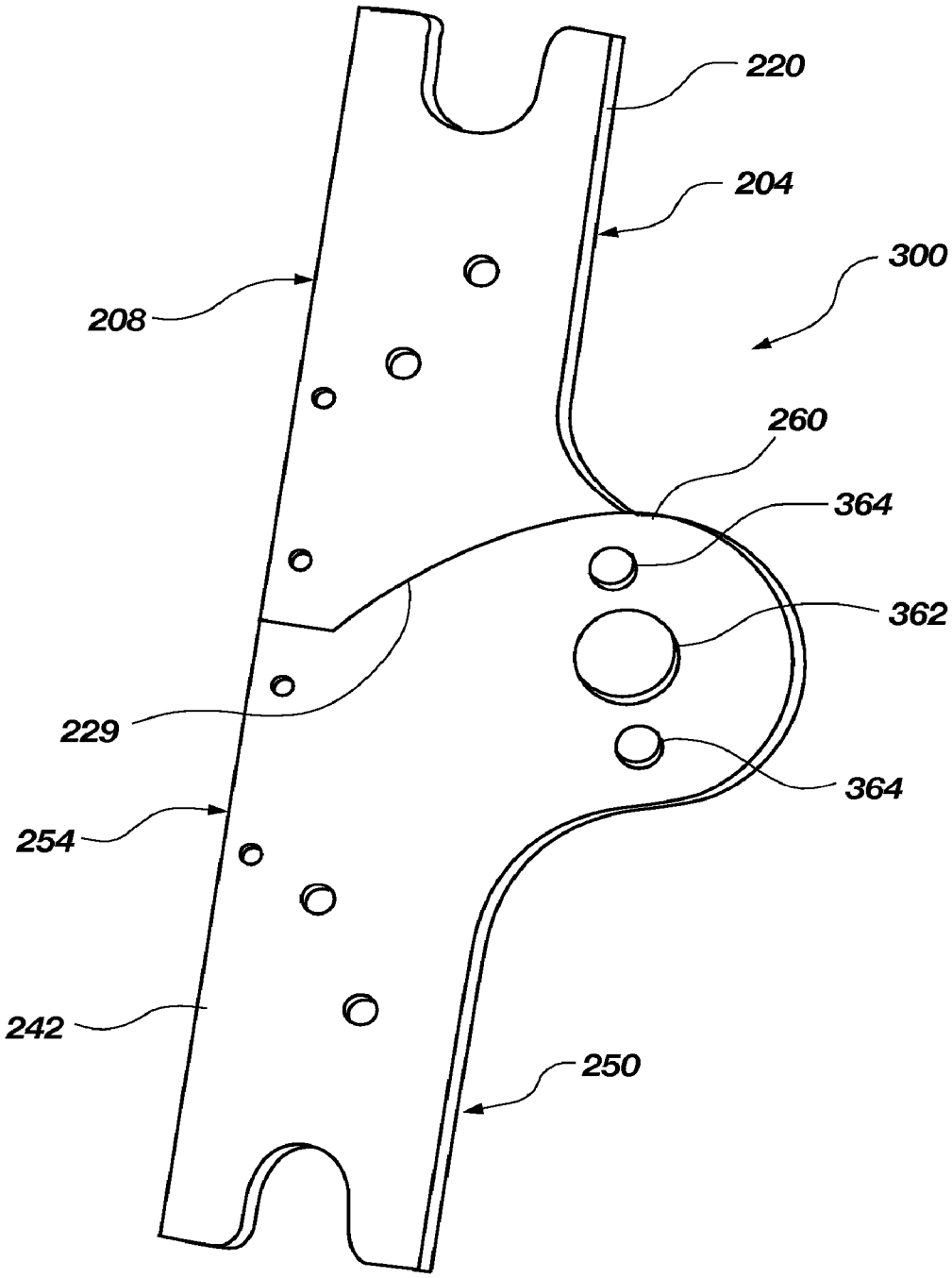
FIG. 7E is a reverse perspective of the hinge assembly of FIG. 7D shown in a closed rotational position.

Referring now to FIG. 7E, the hinge assembly 300 is shown in a closed position and in a reverse view relative to the view shown in FIG. 7D. It is noted that the view presented in FIG. 7E is a reverse view of the hinge components 220 and 242 relative to that which is shown in FIG. 7D and, thus, the pivot pin 362 and locking pins 364 of the selectable hinge positioning and locking mechanism are seen. Upon rotation of the hinge assembly 300 into the closed position, the biased protruding members 350 (see FIG. 7D) are longitudinally displaced within the reinforcement segments 208 and 254 of their respective hinge components 220 and 242. Upon rotation of the hinge assembly 300 out of the closed position, the biased protruding members 350 will again extend outward from their respective hinge components 220 and 242 such as shown in FIGS. 7A and 7D.

Referring briefly to FIGS. 7A, 7D and 7E, another feature of the present invention is shown. The abutment shoulders 229 of the first hinge component 220 are each shaped and configured so as to abuttingly engage one of the laterally spaced plates that define the hinge groove 260 when the hinge assembly 300 is rotated into the closed position (i.e., as shown in FIG. 7E). Thus, when the hinge assembly is in a closed position such as for straight or extension ladder configurations, loadings applied to the ladder are transferred directly between the abutting contact of the two hinge components 220 and 242, including the complementary and cooperative abutting contact of abutment shoulders 229 of the first hinge component 220 with the laterally spaced plates of the hinge groove 260. Such a configuration also enables direct transfer of force between the reinforcement segments 204 and 208 of the first hinge component 220 with the first and second reinforcement segments 250 and 254 of the second hinge component 242. Thus, the first hinge component 220 and second hinge component 242 effectively act as a single continuous beam or column when placed in the closed position. Such is in contrast to prior art mechanisms wherein loadings were transferred solely by way of locking pins 364 (see FIG. 7E).

Although the foregoing description contains many specifics, these should not be construed as limiting the scope of the present invention, but merely as providing illustrations of some exemplary embodiments. For example, while exemplary materials have been discussed regarding the construction of the various embodiments of the present invention, it is noted that different ladder components (e.g., rails, rungs, hinge members, etc.) may be formed of numerous materials including, for example, wood, metals, metal alloys, fiber reinforced composite materials or a combination thereof.

Similarly, other embodiments of the invention may be devised that do not depart from the spirit or scope of the present invention. Features from different embodiments may be employed in combination with one another. The scope of the invention is, therefore, to be construed in accordance with the appended claims and their legal equivalents, rather than by the foregoing description. All additions, deletions, and modifications to the invention as disclosed herein that fall within the meaning and scope of the claims, are to be embraced thereby.

What is claimed is:

1. A ladder comprising:

a first rail assembly including a first rail, a second rail and at least one rung extending between the first rail and the second rail;

a first hinge component coupled with the first rail, the first hinge component having a rail mount section, a tongue portion, a first abutment shoulder on a first side of the first hinge component and a second abutment shoulder on a second side of the hinge component;

a second rail assembly including a third rail and a fourth rail;

a second hinge component coupled with the third rail, the second hinge component having a rail mount section, a first plate segment, a second plate segment spaced apart from the first plate segment and defining a groove between the first plate segment and the second plate segment;

wherein the tongue portion is positioned within the groove and the first hinge component is rotatably coupled with the second hinge component from a first position to a second position, wherein, when in the first position, an edge of a first plate segment is spaced apart for the first abutment shoulder and an edge of the second plate segment is spaced apart from the second abutment shoulder, and wherein, when in the second position, the edge of the first plate segment contacts the first abutment shoulder and the edge of the second plate segment contacts the second abutment shoulder; and an anti-pinch mechanism configured to exert a biasing force between the first hinge component and the second hinge component during a transition of the first hinge component and the second hinge component to the second position, wherein the anti-pinch mechanism includes a first and second biased protuberance positioned along an end of the respective first and second hinge component, wherein, when in the first position, the first and second biased protuberance extend outwardly from the end of the respective first and second hinge component, and wherein, when in the second position, the first and second biased protuberance is displaced within a cavity formed in the respective first and second hinge component with the first biased protuberance in contact with the second biased protuberance.

2. The ladder of claim 1, wherein the first abutment shoulder and the second abutment shoulder each include at least one arcuate section.

3. The ladder of claim 2, wherein the first plate segment engages the first abutment shoulder along substantially an entire length of its associated at least one arcuate section and wherein the second plate segment engages the second abutment shoulder along substantially an entire length of its associated at least one arcuate section.

4. The ladder of claim 1, wherein, when in the second position, the edge of the first plate segment complimentarily engages the first abutment shoulder and the edge of the second plate segment complimentarily engages the second abutment shoulder.

5. The ladder of claim 1, wherein the at least one rung of the first rail assembly includes a first plurality of rungs.

6. The ladder of claim 5, wherein the second rail assembly further includes a second plurality of rungs.

7. The ladder of claim 1, wherein the first hinge component and the second hinge component cooperatively define a beam when in the second position.

8. The ladder of claim 1, wherein the first rail and the third rail extend from each other in a substantially collinear fashion when in the second position, and wherein the first rail and the third rail extend at an angle relative to each other when in the first position.

9. The ladder of claim 1, wherein the first hinge component is a unitary member.

10. The ladder of claim 1, wherein the second hinge component is a unitary member.

11. The ladder of claim 1, wherein the rail mount section of the first hinge is disposed at least partially within an interior volume defined by the first rail and wherein the rail mount section of the second hinge is disposed at least partially within an interior volume defined by the third rail.

12. The ladder of claim 1, wherein the first, second, third and fourth rails comprise fiberglass.

13. The ladder of claim 1, wherein the first, second, third and fourth rails comprise aluminum.

14. The ladder of claim 1, wherein the first hinge component and the second hinge component are each formed of extruded members.

15. The ladder of claim 1, wherein the tongue portion, the first plate segment and the second plate segment each include a peripheral edge having at least one arcuate section.

* * * * *